US006941190B2

(12) United States Patent
Gsell et al.

(10) Patent No.: US 6,941,190 B2
(45) Date of Patent: Sep. 6, 2005

(54) APPARATUS FOR POSITIONING A CARRIAGE FOR LOADING OR UNLOADING A WOUND REEL, SUCH AS PRINTING MATERIAL WEBS FOR WEB-FED ROTARY PRESSES

(75) Inventors: Thomas Gsell, Dillingen (DE); Michael Nimbs, Leibnitz (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 29 days.

(21) Appl. No.: 10/616,516

(22) Filed: Jul. 10, 2003

(65) Prior Publication Data

US 2004/0007446 A1 Jan. 15, 2004

(30) Foreign Application Priority Data

Jul. 12, 2002 (DE) ..... 102 31 521

(51) Int. Cl.[7] ..... G06F 7/00
(52) U.S. Cl. ..... 700/229; 700/228
(58) Field of Search ..... 700/228, 229, 700/112; 198/780, 783, 784

(56) References Cited

U.S. PATENT DOCUMENTS 4,131,206 A 12/1978 Kawada et al.
4,586,673 A 5/1986 Tokuno et al.
4,773,609 A 9/1988 Steffen et al.
6,007,017 A 12/1999 Vorwerk
6,459,224 B2 * 10/2002 Itoh et al. ..... 318/445
6,687,570 B1 * 2/2004 Sussmeier et al. ..... 700/220

FOREIGN PATENT DOCUMENTS

DE 43 34 582 A1 4/1995
EP 0 849 201 A1 6/1998
WO WO 89/08598 9/1989

* cited by examiner

*Primary Examiner*—Khoi H. Tran
(74) *Attorney, Agent, or Firm*—Cohen, Pontani, Lieberman & Pavane

(57) ABSTRACT

In combination with a transport mechanism that includes a plurality of conveyor rollers, an apparatus is used to position a carriage loadable with a wound reel at a desired location on the transport mechanism. The apparatus includes a rotary pulse generator associated with one of the plural conveyor rollers for registering the revolutions of the one of the plural conveyor rollers wherein the revolutions embody a measure of the distance traveled on the transport mechanism by the carriage. The apparatus also includes at least a first and a second initiator for determining the current position of the carriage on the transport mechanism. The first initiator detects a first position of the carriage. The second initiator detects a second position of the carriage. The revolutions of the rotary pulse generator and a distance between the first and second initiator are used to calculate a slip (K), which is used to determine distance (W) between the current position of the carriage and the desired position (S) of the carriage.

21 Claims, 1 Drawing Sheet

APPARATUS FOR POSITIONING A CARRIAGE FOR LOADING OR UNLOADING A WOUND REEL, SUCH AS PRINTING MATERIAL WEBS FOR WEB-FED ROTARY PRESSES

PRIORITY CLAIM

Priority is claimed for this invention and application, corresponding application(s) having been filed in Germany on Jul. 12, 2002, No. 102 31 521.3.

FIELD OF THE INVENTION

The invention relates to an apparatus for positioning a carriage for loading or unloading a wound reel.

BACKGROUND OF THE INVENTION

DE 43 34 582 A1 discloses a reel changer in which the action of reaching the position of the carriage bearing the wound reel is determined by means of a laser that can be moved and is arranged above the sliding platform. For this purpose, the laser is moved to the position calculated for the carriage by the computer of the reel changer, the leading edge of the carriage being registered by means of the laser when the calculated position is reached and, at the same time, a signal being sent to the computer of the reel changer to the effect that the carriage has reached the calculated position.

The laser is arranged externally at a distance from the carriage, so that some inaccuracy in this optical position determination cannot be ruled out.

The disadvantage is that, as the carriage is being moved into the sliding platform, nothing is known about the current position of the carriage. It is, therefore, unknown how accurately or at which precise point the carriage is located on the sliding platform. A further disadvantage is that the laser has to be arranged such that it can be moved.

SUMMARY OF THE INVENTION

In the present invention, a simple but nevertheless accurate apparatus positions a carriage for loading or unloading a wound reel which, in addition, determines the current position of the carriage as it is moved onto a transport apparatus.

In the present invention, advantageously, at any time error-free determination of the exact position of the carriage on the transport mechanism, for example, a sliding platform, is possible. A further advantage is the independence of the width of the wound reel or of the object to be positioned.

It is important that the components for registering the position, in particular rotary pulse generators and initiators, are integrated in the transport mechanism, and no external components for registering position are needed. Furthermore, a minimization of costs can be implemented, since less effort is needed for mounting or there is no external effort for mounting.

Herein, the distance measurement or distance registration is carried out by means of at least one rotary pulse generator, which is arranged on the conveyor rollers of the transport mechanism and converts the revolutions of the conveyor rollers into pulses, and via initiators which are arranged at a predetermined spacing on the transport mechanism. Thus, it is possible to derive a value for the slip from the number of pulses and the distance covered by the carriage, and for a computer to use this value to calculate the exact chronologically current position and/or a remaining distance to reach the exact end position or desired position.

As a result of the installation of initiators, which are activated by means of a stimulus, such as a reaction or a procedure, i.e. trigger initiators as they are known, errors in the distance measurement or distance registration can be minimized. The rotary pulse generator is advantageously equipped as a multi-turn rotary encoder or multi-turn absolute value rotary encoder.

According to the present invention, positioning of the wound reel. Is arranged on a carriage used for loading and unloading in an automatic operation of a reel handling component. Furthermore, according to the present invention, positioning of the core box loaded on a carriage in order to unload a spent core or spent wound reel is possible in an automatic operation of the reel handling component.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
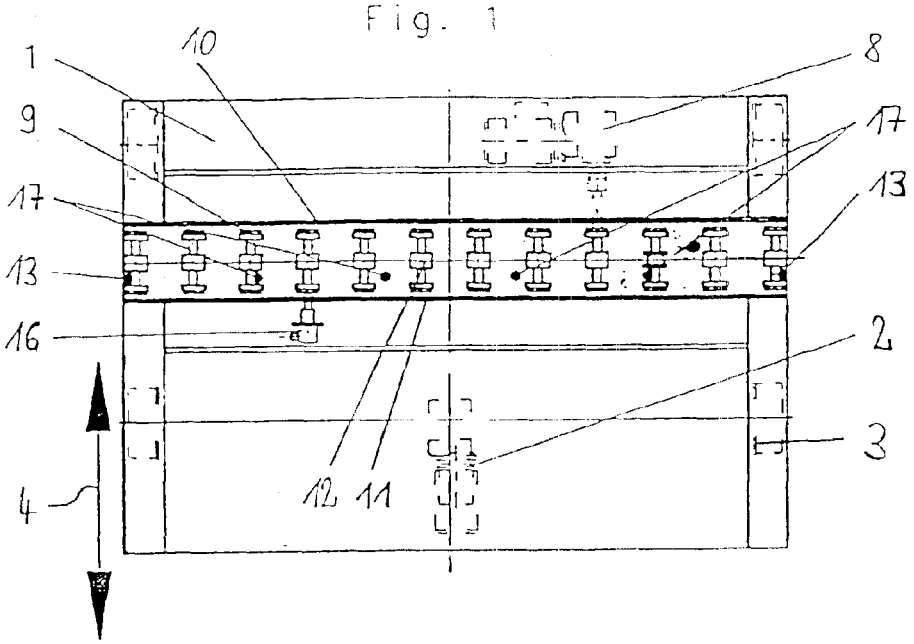
FIG. 1 is a schematic plan view of a transport mechanism and an apparatus for positioning a carriage.
Figure 2:
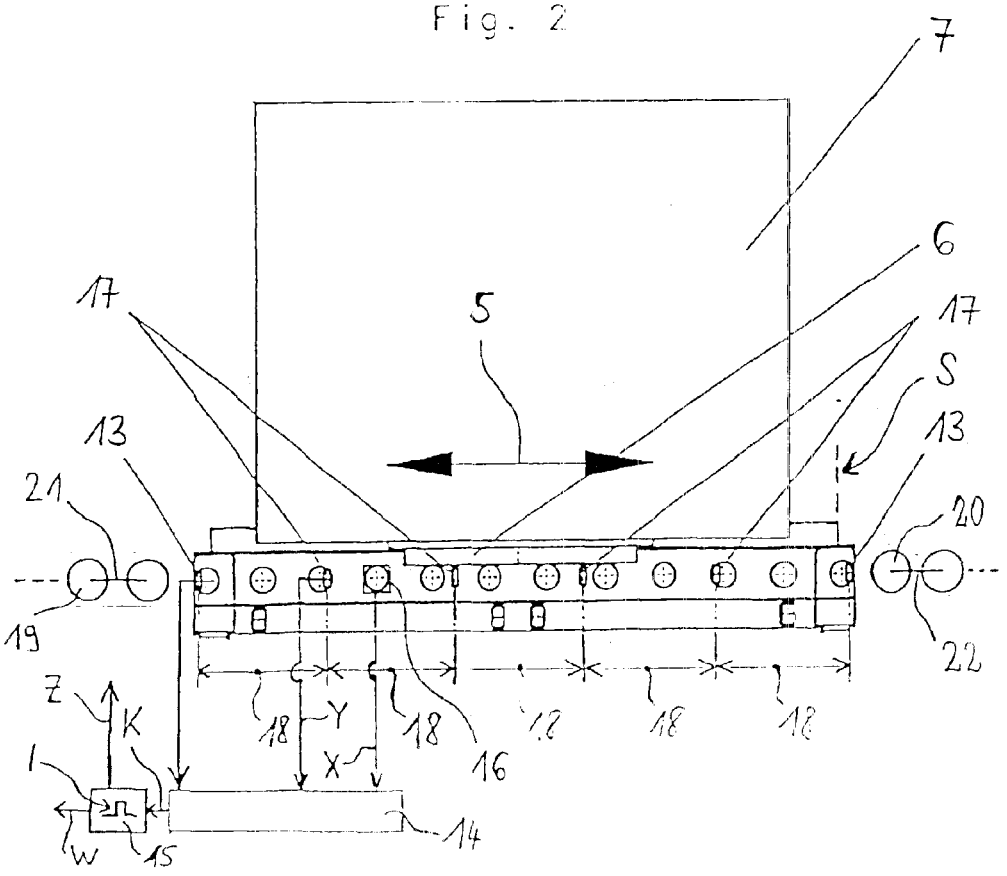
FIG. 2 is a schematic elevational view of the transport mechanism and apparatus for positioning the carriage of FIG. 1 and a wound reel arranged on the carriage.

FIG. 1 shows a transport mechanism 1, for example, a sliding platform, which by means of running rollers 3, that are driven by a motor 2, can be moved in the direction of the double arrow 4 to a reel handling component (not illustrated here), for example, a reel changer. On the transport mechanism 1, a carriage 6, also called a trolley, can be moved in the direction of the double arrow 5 (see FIG. 2). The carriage 6, which may be loaded with a wound reel 7, is initially moved up to the transport mechanism 1 by means of external, fixed-position, driven conveyor rollers 19, 20, for example, a system arranged under the floor.

The external conveyor rollers 19, 20 move the carriage 6 onto the transport mechanism 1 by means of conveyor rollers 9 which are driven by a motor 8 and which are arranged on the transport mechanism 1. Therein, the external driven conveyor rollers 19, 20 assist the action of moving the carriage 6 onto the transport mechanism 1 as long as the carriage 6 still rests on these conveyor rollers 19, 20.

Until the carriage 6 has been moved completely onto the transport mechanism 1, the conveyor rollers 9, 19, 20 rotate at the same speed. Once the carriage 6 has been moved onto the transport mechanism 1, it is moved only by means of conveyor rollers 9. The speed of the conveyor rollers 9 can be reduced for more exact positioning of the carriage 6 on the transport mechanism 1. The conveyor rollers 9, 19, 20 are arranged in the same plane.

The carriage 6 can also be loaded with a core box to accommodate a spent wound reel or spent core to be unloaded from the reel handling component. The individual conveyor rollers 9 are connected to one another with the aid of a circulating drive means 12, which is for example, a chain or a belt, or with the aid a drive shaft. The fixed-position conveyor rollers 19, 20 are also connected to one another with the aid of a circulating drive means 21, 22.

When the carriage 6 is being moved onto the transport mechanism 1 by the external, driven, fixed-position conveyor rollers 19, 20, a first initiator 13 arranged at the inlet to the transport mechanism 1 is activated. Initiator 13 starts a counter 14, which may be set to zero. The initiator 13 thus functions as a start initiator. The initiator 13 is, for example, a sensor that reacts to metal, or a switch, for example, a magnetic switch or a limit switch. The initiator 13 may be activated by non-contact or contact sensing.

Since the external, driven, fixed-position conveyor rollers 19, 20 may be arranged on both sides of the transport mechanism 1, initiators 13 functioning as start initiators are arranged at both input regions of the transport mechanism 1.

Before the carriage 6 is moved onto the transport mechanism 1, the reel width and/or the position of the wound reel 7, which is on the carriage 6, is transmitted to a computing and storage apparatus 15. The computing and storage apparatus 15 is, for example, the reel handling component associated with the control desk of the press, the machine control system or the transport mechanism 1. From these data about the reel width and/or the position of the wound reel 7, the computing and storage apparatus 15 calculates a desired position S of the carriage 6, at which the carriage 6 is to be positioned on the transport mechanism 1. This desired position S is converted into a corresponding number of steps or pulses 1.

Arranged on the driven conveyor rollers 9 of the transport mechanism 1 is at least one rotary pulse generator 16, which, as the conveyor rollers 9 rotate, rotates simultaneously with the latter and, depending on the number of revolutions covered, transmits a corresponding number of pulses X to the counter 14. Once the calculated desired position S of the carriage 6 has been reached, the number of pulses X from the rotary pulse generator 16 stored in the counter 14 must agree with the number of pulses I calculated by the computing and storage apparatus 15. The counter 14 is connected to the computing and storage apparatus 15 or integrated in the computing and storage apparatus 15.

Alternatively, the initiator 13 functioning as start initiator, when the carriage 6 travels over it, can have the effect that storage of the number of pulses X determined by the rotary pulse generator 16 and resulting from the number of revolutions of the conveyor rollers 9 is started in the computing and/or storage apparatus 15, so that the computing and storage apparatus 15 functions as a counter.

However, since moving or transferring of the carriage 6 onto the transport mechanism 1 by means of the driven conveyor rollers 9 is a procedure which is affected by slip, the travel covered or the actual position of the carriage 6 must be determined via at least one further initiator 17 arranged in the direction of travel, that is to say in the direction of the double arrow 5, and must be monitored. For this purpose, the initiator 17 is arranged at a predetermined distance 18 from the first initiator 13.

The initiator 17 is, for example, a sensor that reacts to metal, or a switch, for example, a magnetic switch or a limit switch. The initiator 17 may be activated by non-contact or contact sensing.

The spacing 18 at which the initiators 13; 17 are arranged from each other is an exactly set, fixed value, i.e. is predetermined. This means that after the carriage 6 has traveled over the initiator 17, a predetermined or fixed number of pulses Y corresponding to the distance 18 covered by the carriage 6 is supplied in the counter 14 or in the computing and/or storage apparatus 15.

Thus, in the case of each initiator 13, 17 which is traveled over, the current position of the carriage 6 on the transport mechanism 1 is registered, and this current position, converted into a fixed number of pulses Y, is supplied to the counter or the computing and/or storage apparatus 15.

By using the number of pulses stored in the counter 14 or in the computing and/or storage apparatus 15 and transmitted by the rotary pulse generator 16 during the period of the distance 18 covered, and the defined number of pulses Y or the current position supplied as the initiator 17 is traveled over, a value K for the slip can be calculated, from which, firstly, an exact chronologically current position Z of the carriage 6 may be determined and, secondly, by means of this value K, the residual distance W still to be covered to the calculated desired position S can be determined or calculated by the computing and storage apparatus 15 in a number of pulses or number of revolutions.

If the carriage 6 moves over further initiators 17 fitted to the transport mechanism 1 at a predetermined spacing 18, then the counter 14 starts again as each initiator 17 is traveled over. This means that a new value K is calculated at each initiator 17 over which the carriage 6 travels. Thus, the slip is recalculated at each initiator 17 traveled over by the carriage 6.

The distance covered, and therefore the position of the carriage 6 on the transport mechanism 1, results from a mathematical relationship between the stored number of pulses X from the counter 14 for each millimeter of distance, and the number of subsequently activated initiators 17 and the number of pulses Y correspondingly resulting from the active initiators 17.

The smaller the spacing 18 between the initiators 13; 17, the more initiators 17 can be arranged in the entire movement path of the transport mechanism 1, the more values K are determined and the more error-free and accurate does the positioning of the carriage 6 at the desired position S on the transport mechanism 1 become. Because of direct sensing of the carriage 6 by means of the rotary pulse generator 16 and the initiators 17, the theoretical error approaches zero.

According to the present invention, a carriage 6 with a wound reel 7 arranged thereon with any desired reel position and reel width can be positioned exactly on the transport mechanism 1 and, thus, exactly in relation to the reel handling component.

The apparatus is not intended just to be restricted to be use of a carriage. By means of the apparatus, any desired mobile or moveable transport means, for example, a trolley, can be positioned, for example, on a transport apparatus configured as a sliding platform.

In one embodiment, only one initiator 13 can be arranged on the sliding platform 1 that interacts with at least two activators spaced apart from each other at a predetermined distance, is arranged on the carriage 6 and serves to register the current position of the carriage 6.

Alternatively, not specifically illustrated, the transport apparatus can be equipped as a motor-driven traction rail. The reel handling component, not specifically illustrated, can be, for example, an apparatus for splice preparation. In an apparatus for splice preparation with automatic reel transport, the carriage is additionally also changed. The reel, for example, a wound reel or printing material reel, is lifted by a lifting apparatus for the splicing operation in the apparatus for splice preparation and, during this time, the carriage is changed. In the process, the same problem occurs that the new carriage has to be positioned centrally under the reel, irrespective of the paper width, the reel width being known.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. In combination with a transport mechanism that includes a plurality of conveyor rollers, an apparatus for positioning a carriage at a desired position on the transport mechanism, the carriage being loadable with a wound reel, the apparatus comprising:

a rotary pulse generator (16) associated with one of the plural conveyor rollers (9) for registering the revolutions of the one of the plural conveyor rollers (9) wherein the revolutions embody a measure of the distance traveled on the transport mechanism (1) by the carriage (6);

at least a first and a second initiator (13, 17) for determining the current position of the carriage (6) on the transport mechanism (1), the first initiator (13) for detecting a first position of the carriage (6), the second initiator (17) for detecting a second position of the carriage (6) wherein the revolutions of the rotary pulse generator (16) and a distance between the first and second initiator are used to calculate a slip (K), the slip (K) being used to determine distance (W) between the current position of the carriage (6) and the desired position (S) of the carriage (6).

2. The apparatus of claim 1, wherein the first and the second initiators (13, 17) are separated by a predetermined distance (18).

3. The apparatus of claim 2, wherein the first initiator (13) is arranged at an inlet of the transport mechanism (1);

the second initiator (17) is arranged distal from the first initiator (13) by the predetermined distance; the carriage (6) traveling at least from the first to the second initiator (13, 17);

the rotary pulse generator (16) registers the revolutions of the conveyor rollers (9) in pulses wherein a first number of pulses registered (X) is associated with the carriage (6) at the second initiator (17), a second number of pulses (Y) is associated with the predetermined distance (18) between the first and the second initiator (13, 17), and a third number of pulses (I) is associated with the desired position (S) of the carriage;

the apparatus further comprising a computer (15) associated with the rotary pulse generator (16) and the at least first and second initiators (13, 17), the computer (15) for storing and evaluating the plural number of pulses (X, Y, I) to calculate a slip (K) to determine the distance (W) between the current position of the carriage (6) and the desired position (S) of the carriage (6).

4. The apparatus of claim 3, further comprising a counter (14) associated with the computer (15), the counter (14) for storing the first number of pulses registered (X) associated with the carriage at the second initiator (17).

5. The apparatus of claim 4, wherein the counter (14) is set to zero when the first initiator (13) senses the carriage (6).

6. The apparatus of claim 4, wherein the counter (14) is reset when the second initiator (17) senses the carriage (6).

7. The apparatus of claim 4, wherein the counter (14) becomes usable for determining a new value of the slip (K) when the second initiator (17) senses the carriage (6).

8. The apparatus of claim 4, wherein the rotary pulse generator (16) and the at least first and second initiators (13, 17) are associated with the counter (14).

9. The apparatus of claim 2, wherein the predetermined distance (18) is a fixed value.

10. The apparatus of claim 1, wherein the carriage (6) is moved on to the transport mechanism (1) by the plural conveyor rollers (9).

11. In combination with a transport mechanism that includes a plurality of conveyor rollers, an apparatus for determining the distance between the present location of a carriage of known dimensions and the desired position of the carriage on the transport mechanism, the carriage being loadable with a wound reel, the apparatus comprising:

at least a first and a second initiator (13, 17) for determining the current position of the carriage (6) on the transport mechanism (1), the first initiator (13) for detecting a first position of the carriage (6), the second initiator (17) for detecting a second position of the carriage (6), a rotary pulse generator (16) associated with one of the plural conveyor rollers (9), the rotary pulse generator (16) for registering the revolutions of the one of the plural conveyor rollers (9) wherein the revolutions embody a measure of the distance traveled on the transport mechanism (1) by the carriage (6) from the first to the second initiator; and a computer (15) associated with the rotary pulse generator (16) and the at least first and second initiators (13, 17), the computer (15) evaluating the revolutions of the rotary pulse generator (16) and a distance between the first and second initiator to calculate a slip (K) to determine the distance (W) between the current position of the carriage (6) and the desired position (S) of the carriage (6).

12. The apparatus of claim 11, wherein the first and the second initiators (13, 17) are separated by a predetermined distance (18).

13. The apparatus of claim 12, wherein the first initiator (13) is arranged at an inlet of the transport mechanism (1);

the second initiator (17) is arranged distal from the first initiator (13) by the predetermined distance; the carriage traveling at least from the first to the second initiator (13, 17);

the rotary pulse generator (16) registers the revolutions of the conveyor rollers (9) in pulses wherein a first number of pulses registered (X) is associated with the carriage at the second initiator (17), a second number of pulses (Y) is associated with the predetermined distance (18) between the first and the second initiator (13, 17), and a third number of pulses (I) is associated with the desired position (S) of the carriage;

the apparatus further comprising a computer (15) associated with the rotary pulse generator (16) and the at least first and second initiators (13, 17), the computer (15) for storing and evaluating the plural number of pulses (X, Y, I) to calculate a slip (K) to determine the distance (W) between the current position of the carriage (6) and the desired position (S) of the carriage (6).

14. The apparatus of claim 13, further comprising a counter (14) associated with the computer (15), the counter (14) for storing the first number of pulses registered (X) is associated with the carriage at the second initiator (17).

15. The apparatus of claim 14, wherein the counter (14) is set to zero when the first initiator (13) senses the carriage (6).

16. The apparatus of claim 14, wherein the counter (14) is reset when the second initiator (17) senses the carriage (6).

17. The apparatus of claim 14, wherein the counter (14) becomes usable for determining a new value of the slip (K) when the second initiator (17) senses the carriage (6).

18. The apparatus of claim 14, wherein the rotary pulse generator (16) and the at least first and second initiators (13, 17) are associated with the counter (14).

19. The apparatus of claim 12, wherein the predetermined distance is a fixed value.

20. The apparatus of claim 11, wherein the carriage (6) is moved on to the transport mechanism (1) by the plural conveyor rollers (9).

21. A method of determining the distance between the present location of a carriage of known dimensions and the desired position of the carriage on a transport mechanism using an apparatus in combination with the transport mechanism; wherein the transport mechanism comprises a plurality of conveyor rollers, and the apparatus comprises at least a first and a second initiator for determining a respective first and second instance of the carriage on the transport mechanism and a rotary pulse generator associated with one of the plural conveyor rollers;

the method comprising the steps of:

(a) registering a first instance of the carriage;

(b) registering a second instance of the carriage;

(c) determining the distance traveled by the carriage between the first and second instance;

(d) determining the revolutions of one of the plural conveyor rollers wherein the revolutions embody a measure of the distance traveled on the transport mechanism by the carriage from the first to the second instance; and (e) evaluating the revolutions and a distance between the first and second instance to calculate a slip (K) to determine distance (W) between the current position of the carriage and the desired position (S) of the carriage.

* * * * *